US005325633A

United States Patent [19]

Magoon

[11] Patent Number: 5,325,633

[45] Date of Patent: Jul. 5, 1994

[54] SNAP-IN DOORSTOP AND FLAT FILLER FOR STOREFRONT AND CURTAINWALL FRAMING SYSTEMS

[75] Inventor: Robert D. Magoon, Duluth, Ga.

[73] Assignee: Kawneer Company, Inc., Norcross, Ga.

[21] Appl. No.: 68,987

[22] Filed: May 28, 1993

[51] Int. Cl.[5] ..... E06B 1/04

[52] U.S. Cl. ..... 49/504; 52/204.1; 52/210

[58] Field of Search ..... 49/504, 505; 52/204.1, 52/210, 220.7

[56] References Cited

U.S. PATENT DOCUMENTS

| | | | |
|---|---|---|---|
| 3,469,350 | 9/1969 | Lange | 49/504 |
| 4,205,486 | 6/1980 | Guarnacci | 49/504 X |
| 5,007,221 | 4/1991 | Matthews et al. | 52/464 |
| 5,070,651 | 12/1991 | Jeter | 49/505 |
| 5,159,794 | 11/1992 | Habbersett et al. | 52/204.1 X |

FOREIGN PATENT DOCUMENTS

| | | | |
|---|---|---|---|
| 547862 | 10/1957 | Canada | 49/504 |

OTHER PUBLICATIONS

Excerpts from an Amarlite Architectural Products publication dated Sep. 1988 show a flush filler/center pivot door adapter, Part No. 40565, and an offset pivot door adapter, Part No. 40566.

Excerpts from a YKK publication dated Nov. 1, 1990, disclose two flush filler designs, Part Nos. E9-1010 and E9-1038.

Excerpts from an undated prior art EPCO publication show snap-in door stops Part Nos. 9257S and 9257T, and snap-in pocket adapters Part Nos. 9251S and 9251T.

Excerpts from an Oct. 1989 publication by PPG disclose snap-in fillers Part Nos. 50-710-4224 and 50-710-6224, and snap-in door stops Part Nos. 17-109-4224, 17-109-6224, 17-159-4224, and 17-159-6224.

Excerpts from an undated prior art Vistawall Storefront System publication show a snap-in door stop with gasket, Part No. FG-2120; a snap-in door stop with gasket, Part No. FG-2145; a slide-in pocket filler, Part No. FG-1123; and a snap-in pocket filler, Part No. FG-3126.

An excerpt from an Apr. 1991 publication by U.S. Aluminum shows a door stop with weatherstrip, Part No. DS047, and a filler plate with weatherstrip, Part No. P-427.

*Primary Examiner*—Philip C. Kannan
*Attorney, Agent, or Firm*—Jones & Askew

[57] ABSTRACT

A glazing pocket filler is disclosed for use with a frame member having a glazing pocket of predetermined width for receiving a lateral edge of an infill panel. The glazing pocket filler comprises a filler panel having a length substantially corresponding to the width of the glazing pocket. A spring leg extends inward and forward from the filler panel and has a bearing surface located at a forward end thereof. The spring leg is configured such that when the filler panel is positioned across the glazing pocket, the bearing surface of the spring leg engages an inwardly convex portion of the frame member's forward glazing pocket wall to bias the rearward edge of the filler panel into engagement with the interior glazing pocket edge formation. Simultaneously the spring leg biases the inward face of the filler panel snugly against the outer edges of the frame member's front and rear glazing pocket walls. In this manner the filler panel is maintained in close engagement with the frame member.

8 Claims, 4 Drawing Sheets

SNAP-IN DOORSTOP AND FLAT FILLER FOR STOREFRONT AND CURTAINWALL FRAMING SYSTEMS

TECHNICAL FIELD

The present invention relates generally to storefront and curtainwall framing systems. More specifically, the present invention relates to a snap-in doorstop and flat filler for use in doorways framed in storefront and curtainwall framing systems.

BACKGROUND OF THE INVENTION

Storefront and curtainwall framing systems are well known in which frame members are erected in a grid-like arrangement for glazing infill panels. Such storefront and curtainwall framing systems typically employ a plurality of tubular frame members, each of which defines opposing glazing pockets in its lateral walls. Lateral edges of adjacent glazing panels are received within these glazing pockets. Most often, these glazing pockets are of unequal depth and are referred to as "deep" and "shallow" glazing pockets.

When it becomes necessary to locate a doorway in a storefront or curtainwall framing system, the doorway is typically framed out using the same frame members employed for glazing infill panels. Consequently, the frame members framing the doorway have glazing pockets formed in their lateral faces which must be trimmed to provide a suitable doorway. Depending upon whether a door is to be mounted within the doorway, the filler may comprise either a door stop or a flat filler.

The fillers originally used to trim doorways framed in curtainwall and storefront framing systems include a filler panel having forward and rearward extending flanges which are captured behind U-shaped walls defining gasket grooves formed at the exterior and the interior corners of the glazing pocket. To enable these flanges to be captured behind the walls of the gasket grooves, this type of filler had to be installed by sliding the filler longitudinally onto the frame member. Consequently, the fillers had to be installed either prior to or during the erection of the frame members and could not be installed once the framing system had been erected. Further, because it was not possible to slide such fillers longitudinally onto or off of the frame members once the curtainwall or storefront framing system had been erected, removing and replacing a damaged filler was problematic.

To address these problems, a new type of filler was designed which would permit the filler to be snapped into the frame member. This type of filler overcame the problems associated with longitudinally sliding the filler onto its corresponding frame member, permitting the filler to be installed onto the frame member after the framing system had been erected and further facilitating removal and replacement of damaged fillers subsequent to installation. Examples of this type of filler include the flush filler/center pivot door adapter, part no. 40565, and the offset pivot door adapter, part no. 40566, both manufactured by Amarlite Architectural Products; the flush filler, part no. E9-1010, manufactured by YKK; the snap-in door stop, part nos. 9257S and 9257T, manufactured by EPCO; the snap-in filler, part nos. 50-710-4224 and 50-710-6224, and the door stop snap-in, part no. 17-109-4224 and 17-109-6224, both manufactured by PPG; and the snap-in door stop with gasket, part no. FG-2145, manufactured by Vistawall.

However, this general design of snap-in filler suffers its own problems. First, the filler is dependent for mounting upon a pair of inwardly extending legs which deflect inwardly as the filler is installed to clear the U-shaped walls defining the gasket channels. Upon clearing the gasket channels, the legs then snap outwardly to engage the opposed interior and exterior walls of the glazing pocket. However, to ensure that these legs are able to deflect inwardly by an amount sufficient to clear the gasket channels and still snap outwardly into engagement with the walls of the glazing pocket without exceeding their elastic limits, the legs of the filler necessarily have to be rather long. Consequently, this design of filler is usually suitable only for use in the deep glazing pocket. Thus, if the doorway were accidentally framed with one or more shallow glazing pockets directed inwardly, this type of filler could not be used. At the very least, this design of filler requires additional care during erection of the storefront or curtainwall framing system to ensure that the deep glazing pockets are properly oriented with respect to the framed-in doorway.

Another problem associated with this design of filler is that the action of the opposed spring legs bearing against opposing walls of the glazing pocket causes a "centering" action which tends to center the filler with respect to the underlying glazing pocket. Consequently, if due to design tolerances the filler is slightly narrower than the underlying glazing pocket, a gap is formed between the edges of the filler and the adjacent edges of the glazing pocket. Even in those installations in which a door is mounted within the doorway, the gap between the interior edge of the filler and the adjacent edge of the glazing pocket is still exposed. Further, the mounting arrangement provided by the spring legs render this type of filler susceptible to "rattling" within the glazing pocket.

Efforts have been made to overcome the problems associated with this type of snap-in filler. U.S. Pat. No. 5,007,221 discloses a snap-in glazing pocket filler comprising a filler plate having flanges formed on its inner face. A pair of plastic retaining legs have sockets which engage the flanges such that the legs extend rearwardly and outwardly to engage the walls of the glazing pocket. The sockets are configured such that the legs are capable of a limited degree of rotational movement. The snap-in glazing pocket filler disclosed in the aforesaid U.S. Pat. No. 5,007,221 provides certain advantages over earlier snap-in filler designs, in that the plastic legs and the pivotable mounting arrangement permit the legs to deflect further as the glazing pocket filler is installed without reaching their elastic limit. Consequently, a shorter leg can be used, thereby making this design suitable for use in a shallow glazing pocket as well as a deep glazing pocket. However, this design still does not address other problems associated with snap-in glazing pocket fillers.

SUMMARY OF THE INVENTION

As will be seen, the present invention overcomes these and other problems associated with prior art snap-in fillers for use with doorways framed in storefront and curtainwall systems. Stated generally, the present invention comprises a snap-in filler which can be installed onto a frame member after the framing system has been erected, and which can be removed and replaced if needed after the framing system has been erected. The snap-in filler of the present invention is suitable for use in either the deep or the shallow glazing pocket of the frame member. Further, the filler accommodates manufacturing tolerances without creating gaps between the exposed edge of the filler and the adjacent interior edge of the glazing pocket. Finally the filler is biased snugly against the face of the underlying frame member and does not rattle within the glazing pocket.

Stated more specifically, the present invention comprises a glazing pocket filler for use with a frame member having a glazing pocket of predetermined width for receiving a lateral edge of an infill panel. The glazing pocket filler comprises a filler panel having a width substantially corresponding to the width of the glazing pocket. A spring leg extends inward and forward from the filler panel and has a bearing surface located at a forward end thereof. The spring leg is configured such that when the filler panel is positioned across the glazing pocket, the bearing surface of the spring leg engages an inwardly convex portion of the frame member's forward glazing pocket wall to bias the rearward edge of the filler panel into engagement with the interior glazing pocket edge formation. Simultaneously the spring leg biases the inward face of the filler panel snugly against the outer edges of the frame member's front and rear glazing pocket walls. In this manner the filler panel is maintained in close engagement with the frame member.

In another aspect the present invention comprises a framing system for a doorway. The framing system includes a frame member and a glazing pocket filler of the type described in the preceding paragraph.

In the disclosed embodiment of the present invention, the glazing pocket filler comprises a locking tab which extends inward from the rearward edge of the filler panel. The locking tab is configured such that when the spring leg biases the rearward edge of the filler panel into engagement with the interior glazing pocket edge formation, the locking tab is captured behind the interior glazing pocket edge formation to lock the rearward edge of the filler panel to the frame member. Also in the disclosed embodiment, the locking tab has a beveled surface configured to confront the interior glazing pocket edge formation as the glazing pocket filler is installed in the glazing pocket to bias the glazing pocket filler forward. In this manner the bearing surface of the spring leg is brought into engagement with an inwardly convex wall portion of the forward glazing pocket wall. In a preferred embodiment of the invention, the glazing pocket filler includes an upstanding stop member projecting outward from the filler panel, whereby the glazing pocket filler comprises a door stop.

DETAILED DESCRIPTION OF THE DISCLOSED EMBODIMENT

Figure 1:
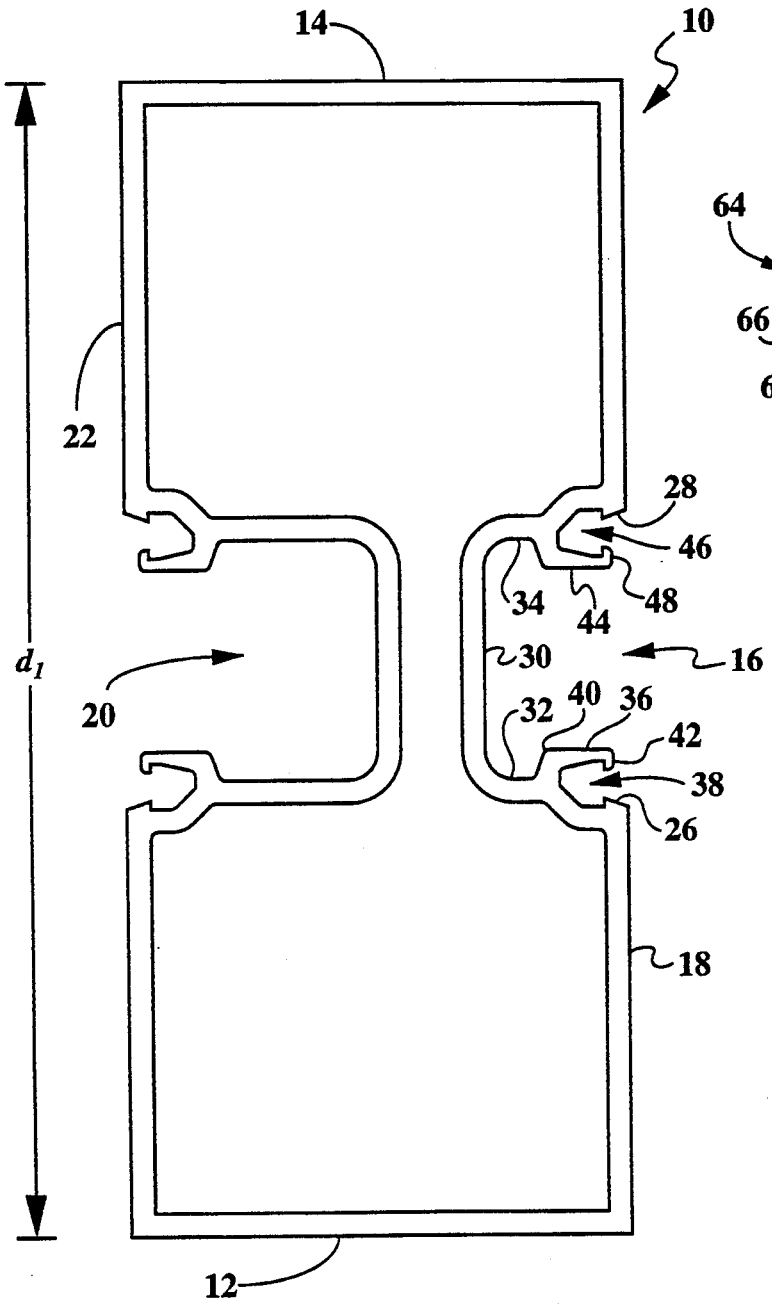
Fig. 1 (Prior Art)
FIG. 1 is an end view of a prior art frame member for curtainwall and storefront framing systems with which the filler of the present invention is used.

Referring now in more detail to the drawings, in which like numerals indicate like elements throughout the several views, FIG. 1 depicts a prior art vertical frame member 10 of the type used in storefront and curtainwall framing systems. The frame member 10 is of a design manufactured and sold by Kawneer Company, Inc., of Norcross, Ga., under the trademark TRIFAB 400. The frame member 10 has a generally tubular configuration and has a depth $d_1$ of four inches as measured between an exterior face 12 and an interior face 14. The frame member 10 further includes a shallow glazing pocket 16 formed in one sidewall 18, and a deep glazing pocket 20 formed in the opposite sidewall 22. The glazing pockets 16, 20 have a width suitable for receiving the lateral edges of one-quarter inch thick infill panels.

Along the lateral edges of the shallow glazing pocket 16, the frame member 10 includes an exterior pocket beveled edge formation 26 and an interior pocket beveled edge formation 28. The shallow glazing pocket 16 includes a bottom pocket wall 30, an exterior pocket wall 32, and an interior pocket wall 34. Comprising the outer end of the exterior glazing pocket wall 32 is a generally U-shaped channel wall 36 which defines an outwardly opening gasket channel 38. The U-shaped channel wall 36 forms an inwardly convex corner 40 angled rearward and inward. The gasket channel wall 36 terminates in an outer lip 42 which projects into the gasket channel 38 and, in normal use, forms a retaining member for a gasket. Similarly, the outer end of the interior glazing pocket wall 34 comprises a generally U-shaped channel wall 44 which defines an outwardly opening interior gasket channel 46 and terminates in an outer lip 48.

It will be understood that the deep glazing pocket 20 is similarly configured with corresponding pocket beveled edge formations, glazing pocket walls, and gasket channels, and these features will therefore not be described in detail.

Figure 2:
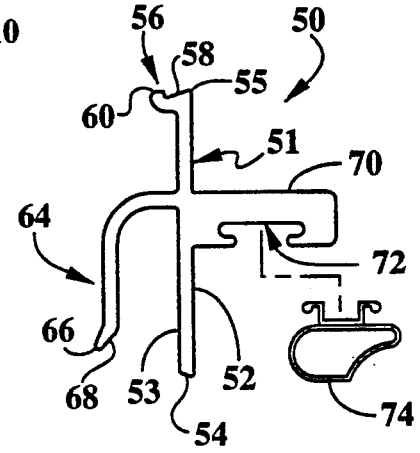
FIG. 2 is an end view of a first embodiment of a snap-in doorstop according to the present invention.

Referring now to FIG. 2, a snap-in doorstop 50 according to the present invention is shown. The doorstop 50 is formed as an elongated extrusion of indeterminate length and is preferably comprised of aluminum or other suitable material. The doorstop 50 includes a filler panel 51 having an outer surface 52, an inner surface 53, and an inwardly beveled forward edge 54. At the rearward edge 55 of the filler panel 51 a locking tab 56 is formed which defines a concave locking surface 58. The inward end 60 of the locking tab 56 is radiused, for reasons which will be explained below.

Extending inward and forward from approximately a midpoint of the inner surface 53 of the filler panel 51 is a spring leg 64. The tip 66 of the spring leg 64 is angled with respect to the major portion of the spring leg and defines a forward and outward facing beveled edge 68. Projecting outwardly from the outer surface 52 of the filler panel 51 is an upstanding doorstop member 70. A door weathering channel 72 is formed in the exterior face of the stop member 70. A gasket 74 engages the door weathering channel 72 in the conventional manner to be retained thereby.

Figure 3:
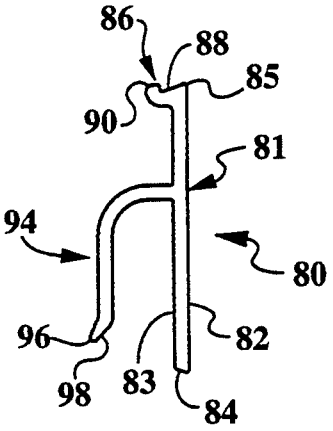
FIG. 3 is an end view of a first embodiment of a snap-in flat filler according to the present invention.

Referring now to FIG. 3, a snap-in flat filler 80 is illustrated which is substantially identical to the snap-in doorstop 50 with the exception of the absence of an upstanding doorstop member. The snap-in flat filler 80 includes a filler panel 81 having an exterior surface 82, an interior surface 83, and a forward edge 84. At the rearward edge 85 of the filler panel 81 a locking tab 86 is formed and defines a concave locking surface 88. The tip 90 of the locking tab 86 is radiused. Projecting inward and forward from the inner surface 83 of the filler panel 81 is a spring leg 94. The tip 96 of the spring leg 94 is angled with respect to the major portion of the spring leg and defines a beveled edge 98.

Figure 4C:
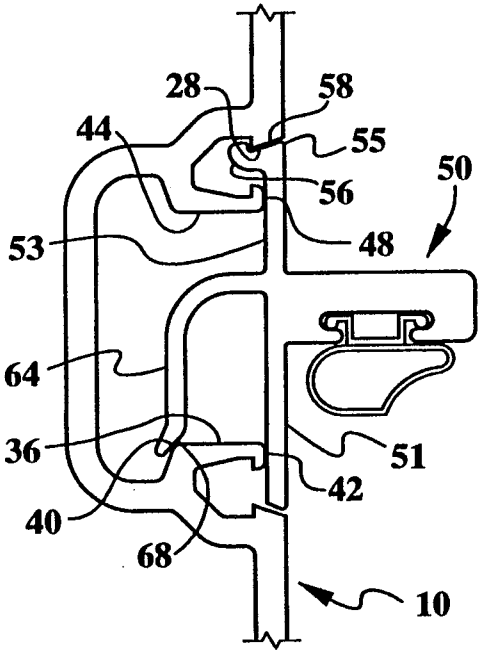
FIGS. 4A–4C depict the installation sequence of the snap-in doorstop of FIG. 2 onto the frame member of FIG. 1.
Figure 4B:
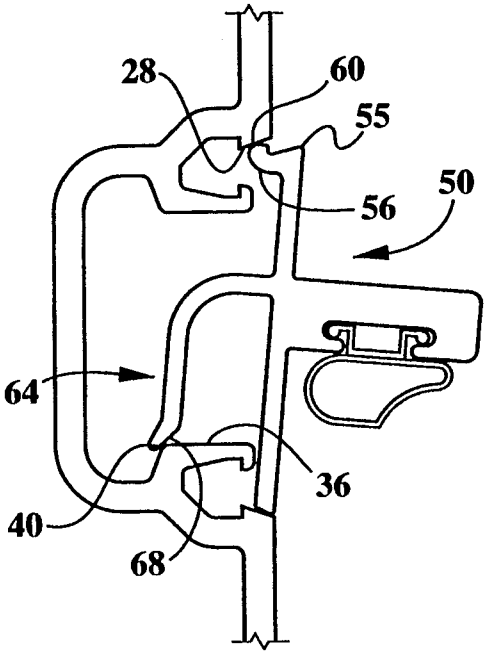
Figure 4A:
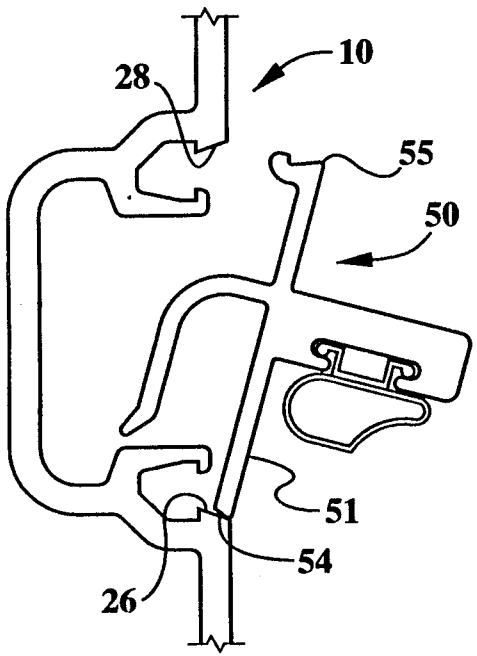

Installation of the snap-in doorstop 50 onto the frame member 10 is illustrated in FIGS. 4A–4C. Looking first at FIG. 4A, the forward edge 54 of the filler panel 51 is placed against the exterior glazing pocket beveled edge formation 26 of the frame member 10. The rearward edge 55 of the filler panel 51 is then pivoted inward toward the interior pocket beveled edge 28 of the frame member 10. As shown in FIG. 4B, the radiused surface 60 at the tip of the locking tab 56 confronts the beveled surface of the interior pocket edge formation 28. Further rotation of the rearward edge 55 of the stop member 50 thus biases the stop member 50 toward the exterior and brings the beveled edge 68 of the spring leg 64 into contact with the rearwardly and inwardly angled corner 40 of the exterior gasket channel wall 36.

Referring now to FIG. 4C, as the snap-in stop member 50 is rotated further, the locking tab 56 snaps behind the interior pocket beveled edge formation 28, capturing the rearward end 55 of the stop member. In this position, the beveled edge 68 of the spring leg 64 presses against the rearwardly and inwardly angled corner 40 of the exterior gasket channel wall 36. The spring leg 64 thus exerts a force on the filler panel 51 which has both a rearward component and an inward component. The rearward component forces the locking surface 58 at the rearward edge 55 of the stop member 50 firmly against the interior pocket beveled edge formation 28 of the frame member 10. The inward component of the force exerted by the spring leg 64 draws the inner surface 53 of the filler panel 51 snugly against the lips 42, 48 of the exterior and interior gasket channel walls 36, 44.

Figure 5:
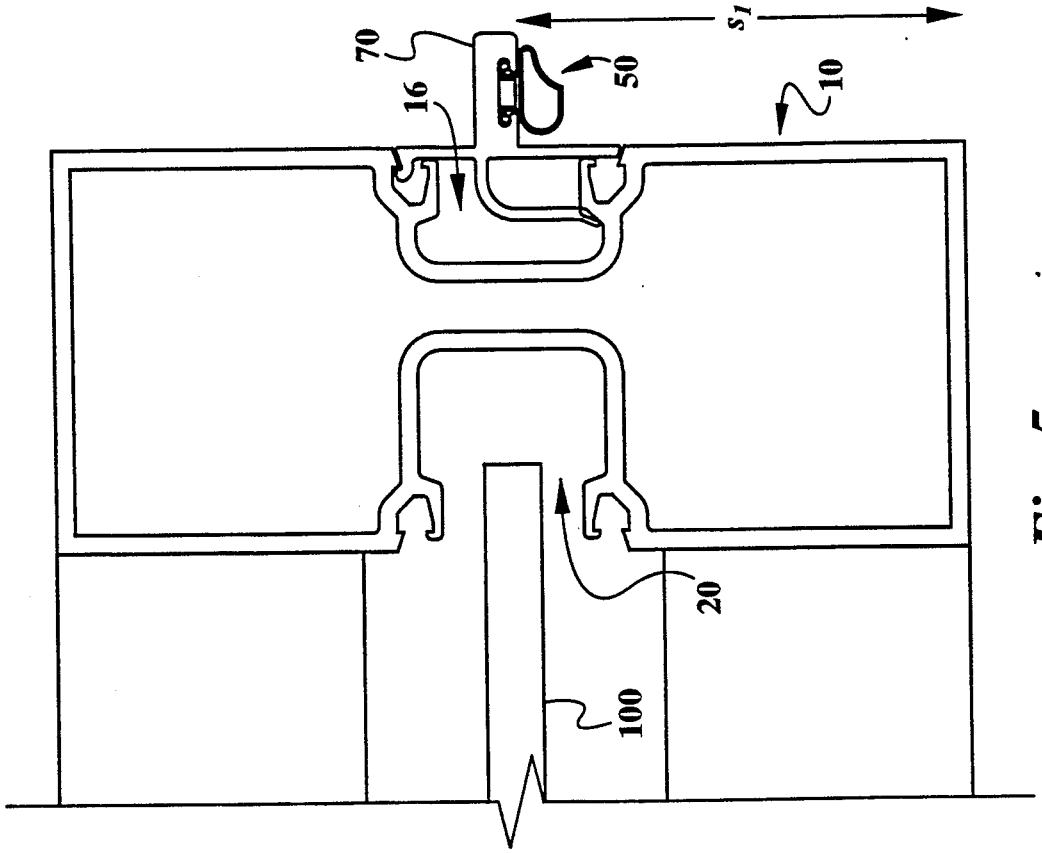
FIG. 5 is an end view of the snap-in doorstop of FIG. 2 mounted to the frame member of FIG. 1.

FIG. 5 shows a completed installation comprising a snap-in doorstop 50 installed onto a frame member 10. As shown in FIG. 5, the snap-in doorstop 50 is installed in the shallow glazing pocket 16, while a one-quarter inch thick infill panel 100 is received within the deep glazing pocket 20. However, it will be appreciated that the snap-in doorstop 50 may be just as easily installed in the deep glazing pocket 20, leaving the shallow glazing pocket 16 free to receive the lateral edge of an infill panel. As shown in FIG. 5, the upstanding stop member 70 of the snap-in doorstop is set back from the plane defined by the exterior face 12 of the frame member 10 by a distance $s_1$ of 1 31/32". This backset will accommodate a 1¾" thick door with the front face of the door being inset from the exterior face of the door frame by one-eighth of an inch.

Figure 6:
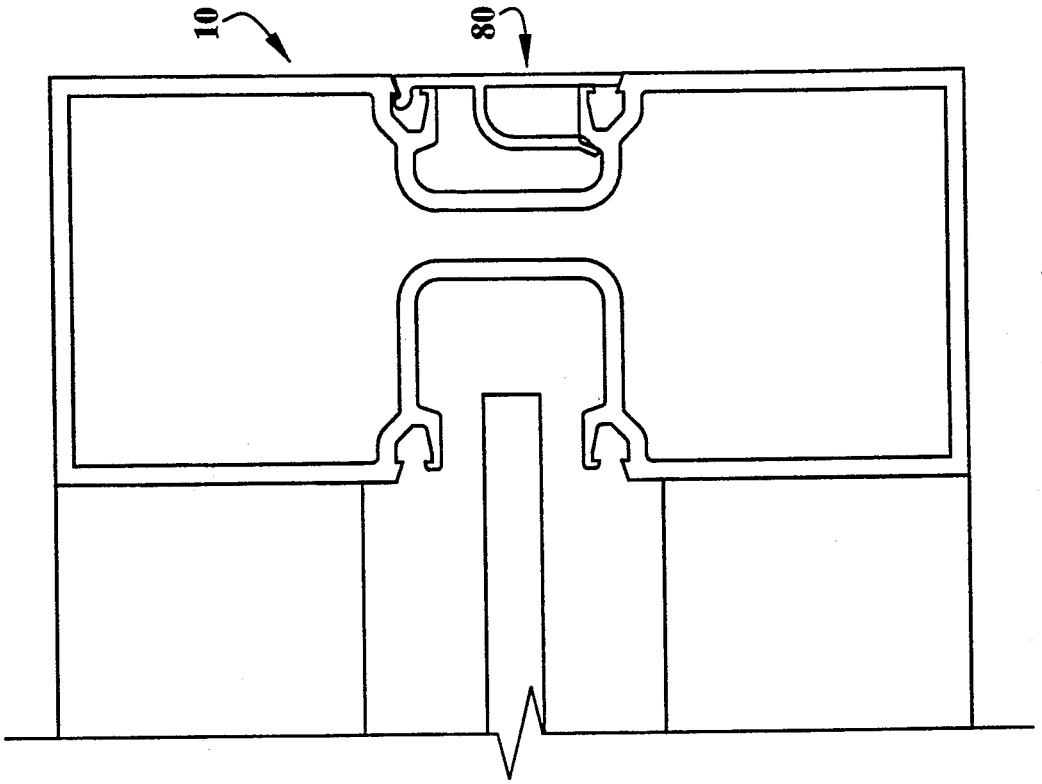
FIG. 6 is an end view of the snap-in flat filler of FIG. 3 installed onto the frame member of FIG. 1.

FIG. 6 shows the snap-in flat filler 80 installed onto a frame member 10. It will be appreciated that the arrangement by which the snap-in flat filler 80 is mounted to the frame member 10 is identical to the mounting arrangement of the snap-in doorstop 50. Further, the installation sequence for the snap-in flat filler 80 is the same as described hereinabove with respect to the snap-in doorstop 50, as discussed with reference to FIGS. 4A–4C.

Figure 7:
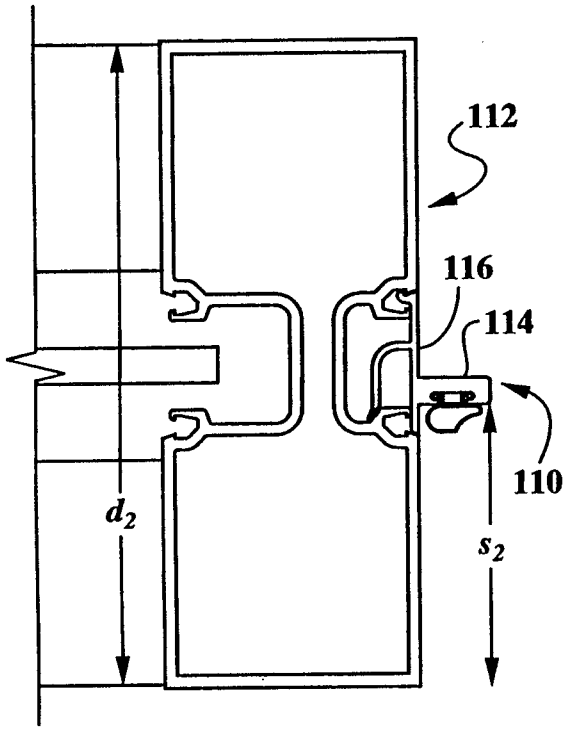
FIG. 7 depicts a second embodiment of a snap-in doorstop according to the present invention, installed onto a frame member for storefront and curtainwall framing systems having a deeper profile than the frame member of FIG. 1.

FIG. 7 shows a second embodiment of a snap-in doorstop 110 according to the present invention. The snap-in doorstop 110 of the second embodiment is adapted for use on a frame member 112 having a deeper profile than the frame member 10 previously described. The frame member 112 depicted in FIG. 7 is manufactured and sold by Kawneer Company, Inc., under the mark TRI-FAB 450. The frame member 112 has a depth $d_2$ of 4½" and glazing pockets adapted to receive one-quarter inch thick infill panels.

The snap-in doorstop 110 of the second embodiment is identical to the snap-in doorstop 50 with the exception that an upstanding stop member 114 is set one-quarter of an inch further forward on the infill panel 116 to maintain a door inset $s_2$ of 1 31/32". In all other respects, the mounting arrangement and installation sequence of the snap-in doorstop 110 is identical to that of the snap-in doorstop 50 of the first embodiment.

Since the configuration of the snap-in flat filler is independent of the depth of the frame member, the same snap-in flat filler 80 disclosed above with respect to the 4" deep frame member 10 is equally suitable for use on the 4½" deep frame member 112 and hence need not be discussed in further detail.

Figure 8:
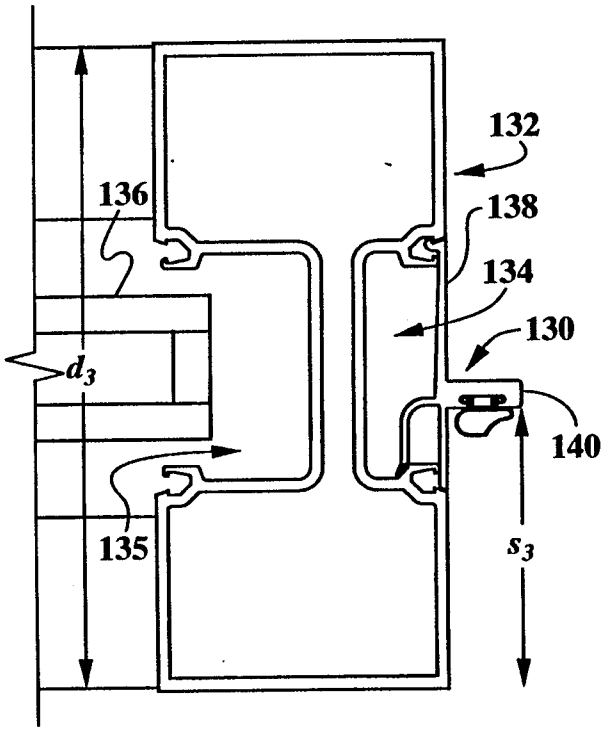
FIG. 8 depicts a third embodiment of a snap-in doorstop according to the present invention, mounted to a frame member having a deeper profile and wider glazing pockets than the frame member of FIG. 1 for accepting deeper infill panels.

FIG. 8 shows a third embodiment of a snap-in doorstop 130 installed onto a frame member 132. The frame member 132 is of the type manufactured and sold by Kawneer Company, Inc., under the trademark TRI-FAB 451. The frame member has a depth $d_3$ of 4½" and includes wider glazing pockets 134, 135 adapted to receive the lateral edges of one-inch thick infill panels 136. The filler panel 138 of the snap-in doorstop 130 is correspondingly wider to conceal the wider glazing pocket 134, and the upstanding stop member 140 is located at a position forward on the filler panel 138 which will provide a door inset $s_3$ of 1 31/32". In all other respects, the mounting arrangement and installation sequence of the snap-in doorstop 130 is the same as previously described with respect to the snap-in doorstop 50 of the first embodiment.

Figure 9:
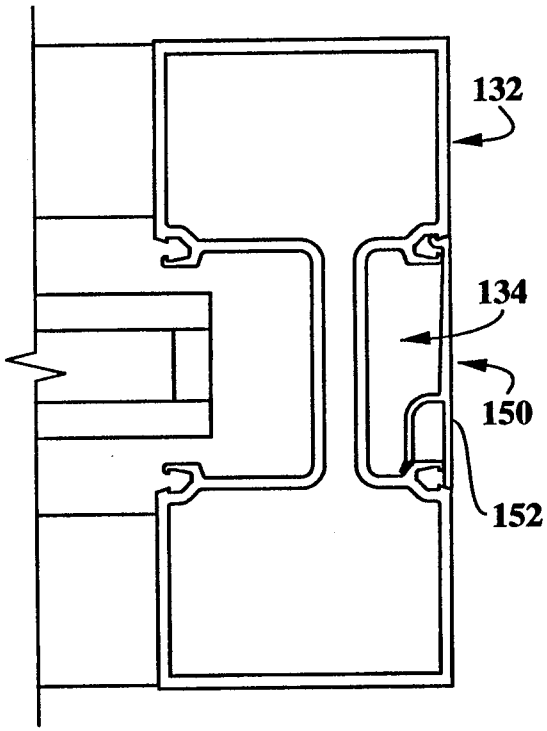
FIG. 9 depicts a second embodiment of a snap-in flat filler according to the present invention, mounted to a frame member of the type depicted in FIG. 8.

FIG. 9 discloses a second embodiment of a snap-in flat filler 150 installed onto a frame member 132 of the same type disclosed in FIG. 8. To accommodate the wider glazing pocket 134, the filler panel 152 of the snap-in flat filler 150 is correspondingly wider. However, the snap-in flat filler 150 is otherwise identical to the snap-in flat filler 80 previously disclosed, and the mounting arrangement and installation sequence are as hereinabove described with respect to the snap-in flat filler 80.

The snap-in flat fillers 50, 80, 110, 130, and 150 provide several advantages over prior art snap-in fillers. First, by employing a single spring leg rather than an opposing pair of spring legs, the fillers are biased toward the interior of the frame member rather than centered over the glazing pocket. This arrangement prevents any gap between the rearward edge of the snap-in filler and the corresponding beveled edge formation of the glazing pocket. If manufacturing tolerances result in a gap between the forward edge of the snap-in filler and the corresponding beveled edge formation of the glazing pocket, such a gap will be concealed by the door, while the exposed joint at the interior edge of the glazing pocket will be free of gaps.

Second, the spring legs of the snap-in flat fillers 50, 80, 110, 130, and 150 exert a force on the fillers which has a major component in both a rearward and an inward direction. Consequently, not only are the fillers urged snugly against the rear beveled glazing pocket wall, but also the fillers are forced tightly against the lips of the gasket channels, thereby retaining the fillers firmly within their respective channels.

A further advantage of the snap-in flat fillers 50, 80, 110, 130, and 150 is that their shallow profiles make them equally well suited for installation in either a deep or a shallow glazing pocket. Thus the necessity for the doorway to be framed with the deep glazing channels oriented inward is eliminated.

It will be understood that the frame members 10, 112, and 132 are disclosed herein by way of example, and that the invention is by no means limited to snap-in flat fillers configured for use with these specific frame members.

Finally, it will be understood that the foregoing embodiments have been disclosed by way of example, and that other modifications may occur to those skilled in the art without departing from the scope and spirit of the appended claims.

What is claimed is:

1. A glazing pocket filler for use with a frame member having a glazing pocket of predetermined width for receiving a lateral edge of an infill panel, said frame member further including an interior glazing pocket edge formation and front and rear glazing pocket walls having outer edges, and said forward glazing pocket wall including an inwardly convex wall portion, said glazing pocket filler comprising:

a filler panel having an inward face, a forward edge, and a rearward edge, and having a length substantially corresponding to said predetermined width of said glazing pocket; and a spring leg extending inward and forward from said filler panel and having a bearing surface located at a forward end thereof;

said spring leg being configured such that when said filler panel is positioned across said glazing pocket said bearing surface of said spring leg engages said inwardly convex wall portion of said forward glazing pocket wall to bias said rearward edge of said filler panel into engagement with said interior glazing pocket edge formation and simultaneously to bias said inward face of said filler panel snugly against said outer edges of said front and rear glazing pocket walls.

2. The glazing pocket filler of claim 1, further comprising a locking tab extending inward from said rearward edge of said filler panel and configured such that when said spring leg biases said rearward edge of said filler panel into engagement with said interior glazing pocket edge formation, said locking tab is captured behind said interior glazing pocket edge formation to lock said rearward edge of said filler panel to said frame member.

3. The glazing pocket filler of claim 2, wherein said locking tab further comprises a beveled surface configured to confront said interior glazing pocket edge formation as said glazing pocket filler is installed in said glazing pocket to bias said glazing pocket filler forward, said bearing surface of said spring leg thereby being brought into engagement with said inwardly convex wall portion of said forward glazing pocket wall.

4. The glazing pocket filler of claim 1, further comprising an upstanding stop member projecting outward from said filler panel, whereby said glazing pocket filler comprises a door stop.

5. A framing system for a doorway, comprising:

a frame member having a glazing pocket of predetermined width for receiving a lateral edge of an infill panel, said frame member further including an interior glazing pocket edge formation and front and rear glazing pocket walls having outer edges, and said forward glazing pocket wall including an inwardly convex wall portion;

a filler panel having an inward face, a forward edge, and a rearward edge, and having a length substantially corresponding to said predetermined width of said glazing pocket; and a spring leg extending inward and forward from said filler panel and having a bearing surface located at a forward end thereof;

said spring leg being configured such that when said filler panel is positioned across said glazing pocket said bearing surface of said spring leg engages said inwardly convex wall portion of said forward glazing pocket wall to bias said rearward edge of said filler panel into engagement with said interior glazing pocket edge formation and simultaneously to bias said inward face of said filler panel snugly against said outer edges of said front and rear glazing pocket walls.

6. The glazing pocket filler of claim 5, further comprising a locking tab extending inward from said rearward edge of said filler panel and configured such that when said spring leg biases said rearward edge of said filler panel into engagement with said interior glazing pocket edge formation, said locking tab is captured behind said interior glazing pocket edge formation to lock said rearward edge of said filler panel to said frame member.

7. The glazing pocket filler of claim 6, wherein said locking tab further comprises a beveled surface configured to confront said interior glazing pocket edge formation as said glazing pocket filler is installed in said glazing pocket to bias said glazing pocket filler forward, said bearing surface of said spring leg thereby being brought into engagement with said inwardly convex wall portion of said forward glazing pocket wall.

8. The glazing pocket filler of claim 5, further comprising an upstanding stop member projecting outward from said filler panel, whereby said glazing pocket filler comprises a door stop.

* * * * *